US010617940B1

(12) United States Patent
Nadeau

(10) Patent No.: US 10,617,940 B1
(45) Date of Patent: Apr. 14, 2020

(54) DICE GAME SYSTEM, METHOD AND APPARATUS

(71) Applicant: Steven Nadeau, Las Vegas, NV (US)

(72) Inventor: Steven Nadeau, Las Vegas, NV (US)

( * ) Notice: Subject to any disclaimer, the term of this patent is extended or adjusted under 35 U.S.C. 154(b) by 0 days.

(21) Appl. No.: 16/118,407

(22) Filed: Aug. 30, 2018

(51) Int. Cl.
*A63F 9/04* (2006.01)
*A63F 1/06* (2006.01)

(52) U.S. Cl.
CPC ..... *A63F 9/0406* (2013.01); *A63F 1/067* (2013.01); *A63F 2009/0411* (2013.01)

(58) Field of Classification Search
CPC . A63F 9/0406; A63F 1/067; A63F 2009/0411
See application file for complete search history.

(56) References Cited

U.S. PATENT DOCUMENTS 3,724,857 A * 4/1973 Marino ..... A63F 9/0406 273/145 B
5,662,330 A * 9/1997 Spears ..... A63F 3/00157 273/274
2010/0140867 A1* 6/2010 Malmloff ..... A63F 1/10 273/145 A

* cited by examiner

*Primary Examiner* — Jeffrey S Vanderveen
(74) *Attorney, Agent, or Firm* — Newman Law, LLC

(57) ABSTRACT

A dice game method and game apparatus comprising a game table surface having a generally semicircular peripheral edge about which a plurality of player positions are located, the game table surface having designated thereon a plurality of wagering receiving areas corresponding to each of the player positions in a repetitive pattern along a peripheral portion of the game table surface, the wager receiving areas designating the only place on which the players may place a wager and the wager is received; a set of at least two dice having six faces with numerical representations thereon; and a tumbler, comprising: a base; an axial tube having a curved wall, a first end and a second end defining an inner volume, the first end of the axial tube being removably connected with the base; and a transverse tube having a curved wall, an open first end and an open second end, the second end of the transverse tube being securely connected to the second end of the axial tube and extending into the inner volume of the axial tube at a transverse angle relative to the axial tube, wherein the second end and a portion of the curved wall of the transverse tube are adjacent to an inner portion of the curved wall of the axial tube.

1 Claim, 12 Drawing Sheets

DICE GAME SYSTEM, METHOD AND APPARATUS

BACKGROUND OF THE INVENTION

Field of the Invention

The present invention relates to the field of gaming, particularly to the field of wagering games involving random gaming implements, such as dice or cards, and more particularly to modified and unique wagering games which include additional implements for facilitating the randomness and security of game play.

Background of the Art

The invention relates to the field of casino table wagering games, particularly casino table dice games related to the play of the game of craps, and most particularly to side bet wagers that may be placed in the underlying game of craps.

As gaming continues to enjoy widespread acceptance, casinos are increasingly in need of new games of chance to retain and attract patrons. While electronic gaming devices (e.g., slot machines) attract the most attention, many players prefer the skill requirements and personal interaction of live gaming. Thus, live gaming continues to be an integral component to the success of any casino.

The game of craps is a popular and long established casino table wagering game. In Craps, each player places at least one of the various wagers indicated below before the dice are thrown by the shooter. Since the pair of dice provides 36 possible outcomes for a single roll of one standard pair of dice, there are 36 possible outcomes on each and every roll of the dice in the standard game of craps.

The standard wagers include a "Pass Line" wager. The player will lose this wager on a shooter opening throw totaling 2, 3, or 12, and will lose all money wagered on this area. The player will win the Pass Line wager on a shooter opening throw totaling 7 or 11. Thus, a player either wins or loses the Pass Line wager on an opening throw of 2, 3, 7, 11, or 12. If these values do not appear on the opening roll, then a "Point" is established. The possible Point numbers are therefore 4, 5, 6, 8, 9, or 10. Once the Point is established, if the shooter throws the same Point number in a subsequent throw, then the Pass Line wager wins. However if the shooter throws a 7, then the Pass Line wager loses and the series ends. This occurrence is commonly referred to as a "seven out." After a seven out, the dice are typically passed to a new shooter.

Craps has been an established part of the casino environment for over a hundred years. It is believed that the excitement of the game, some relatively favorable wagers/odds and the camaraderie of the game have required major casinos to continue offering the game. However, Craps is a labor intensive game, with a minimum of two personnel present at the table during play, and can be intimidating for new players.

While Craps is a popular game, many new games which are quickly rising in popularity are modified versions of existing games. Consequently, further variations of existing wagering games are always of interest to players and casino operators. A modified version of the game of Craps, which may be less labor intensive version and less intimidating, while providing numerous wagering opportunities, thus increasing player participation and excitement, would be attractive to players and casino operators.

SUMMARY OF THE INVENTION

Some embodiments of the invention are directed to a method and system for providing a wagering game involving the use of dice roll results in determining wagering outcomes which advances upon the game of Craps.

Some embodiments of the invention are directed to a method of administering such a wagering game, comprising the steps of: receiving a pre-initial roll wager prior to an initial dice roll result in a series; generating a random dice roll result; determining the outcome of the wager based on a comparison of the dice roll result with preset initial roll wagering outcome criteria; determining if a series ending event has occurred; receiving additional wagers, which may be differ from the pre initial roll wager and generating an additional random dice roll result as part of the series if the series ending event is determined to have not occurred; resolving the additional wagers received based on a comparison of each dice roll result with the respective preset wagering outcome criteria; collecting all wagers placed as a result of a series ending event occurring and restarting a new series upon receipt of a new pre-initial roll wager.

Some embodiments of the invention are directed to a dice game method and game apparatus comprising a game table surface having a generally semicircular peripheral edge about which a plurality of player positions are located, the game table surface having designated thereon a plurality of wagering receiving areas corresponding to each of the player positions in a repetitive pattern along a peripheral portion of the game table surface, the wager receiving areas designating the only place on which the players may place a wager and the wager is received.

In some embodiments, the dice game method and game apparatus may further include a set of at least two dice having six faces with numerical representations thereon.

In some embodiments, the dice game method and game apparatus further includes a tumbler, comprising: a base; an axial tube having a curved wall, a first end and a second end defining an inner volume, the first end of the axial tube being removably connected to the base; and a transverse tube having a curved wall, an open first end and an open second end, the second end of the transverse tube being securely connected to the second end of the axial tube and extending into the inner volume of the axial tube at a transverse angle relative to the axial tube, wherein the second end and a portion of the curved wall of the transverse tube are adjacent to an inner portion of the curved wall of the axial tube.

It should be understood that the dice game method as discussed herein below, and game apparatus, as mentioned above and discussed in greater detail herein below, whether alone or combined, provide enhanced game play, game integrity and security features, among other things.

BRIEF DESCRIPTION OF THE DRAWINGS

While the disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION OF SOME EMBODIMENTS OF THE INVENTION

It should understood that the invention is generally directed to systems, methods and apparatus for providing, operating, hosting and conducting interactive wagering games generally involving sequences of controlled and concrete transformative events or steps, the generation of random results or data, and the use and application of the randomly generated results in a manner which provides for the resolution of both prior and/or subsequent events or steps.

In the exemplary embodiments disclosed herein, the invention includes various steps such as those involving the receiving of wagers, provision of randomly generated gaming implements, distribution of the gaming implements according to preset formations and procedures, comparison of one or more of such formations with preset criteria, determining the outcome of wagers received and then settling the wagers depending on the determined outcome by one of either the following actions: collecting the wagers; distributing an award payout; and returning the wager received.

It should be understood that the words "wager," "wagering," "betting" or "bet," or the like, refers to any type of points, money, credits, items of value, including physical or virtual representations thereof, which are placed at risk in that they may be forfeit depending on the occurrence and application of randomly generated data. Additionally, it should also be understood that gaming implements may include standard or customized dice or playing cards, and may be provided in a physical form, such as a set of dice or randomly-ordered group of shuffled cards, or in a virtual form, such as a display device operatively associated with a processing device, memory and random number generator for creating a depiction of a gaming implement on the display device and generating random results to simulate the random results of physical gaming implements.

Each of the methods and individual steps recited herein may be partially or wholly carried out in a variety of ways and/or systems, which may include, but are not limited to, a live dealer physically dealing or using gaming implements in a casino, an electronic gaming machine (EGM) or kiosk for one or more players in which a live dealer distributes or uses gaming implements, such as dice, which may be in combination with a mechanism such as a camera or sensors for determining game outcomes by processing the random results with a data processor, or gaming implements are provided through a program which may include a random number generator, standalone multiplayer platforms which may include a player interface such as a touchscreen display and a physical or virtual gaming implements, through a home computer or portable computing device, such as a tablet computer or mobile phone capable of communicating with a network or over the Internet, global telecommunication network or world wide web.

Figure 1:
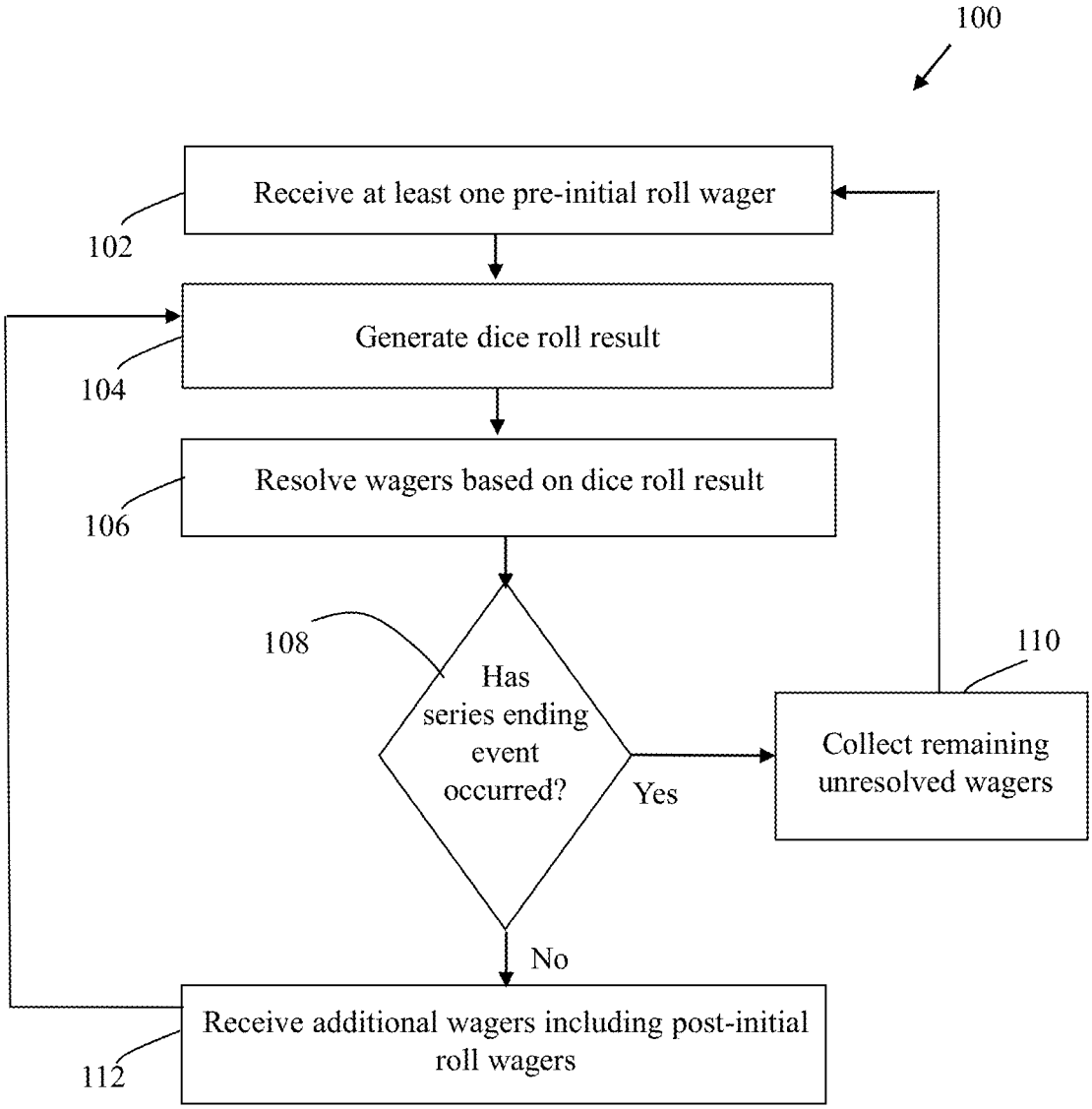
FIG. 1 is a process flow chart depicting an exemplary method for conducting a wagering game configured and constructed according to some embodiments of the invention.

FIG. 1 provides an exemplary embodiment of the invention for providing a wagering game generally referred to by the reference numeral 100. In step 102, an initial pre-roll result wager is received from one or more players. This step may involve receiving multiple initial pre-roll result and thereafter, additional, secondary, post-initial roll result wagers as discussed herein.

It should be understood that receiving a wager, whether an initial wager or secondary wager as described herein, generally involves positioning of the physical representations of monetary amounts (e.g., tokens or chips) into a designated area on the surface of a physical gaming table. The gaming table surface may include various areas designated thereon for placing wagers for receipt thereof, including an associated wager area for the side wager and an underlying game wager area, and designed areas for placing gaming implements, such as designated player positions for player wagers and gaming implements, and designated areas for the dealer and revealed gaming implements as discussed herein.

Wagering in the exemplary embodiment is generally based on the probability of random results generated from the roll of dice, that is, results which may include either two, three, four, five, six, seven, eight, nine, ten, eleven or twelve. While multiple players may play the game, a single roll result will determine the outcome of certain wagers, while multiple outcomes in a series of rolls may determine the outcome of other certain wagers, some of which wagers may be received as an initial pre-roll wager or a post-initial roll wager. A post-initial wager is any wager received after the initial roll result is received and before a series ending event occurs, such as a roll result of a certain number, such as seven. Once a series ends, a new series begins with an initial roll, thus enabling pre-initial roll wagers to be placed again. In some embodiments, all post-initial roll wagers are forfeit upon the occurrence of a series ending event, while in other embodiments these wager may push or remain viable in subsequent series.

Determining the outcome of wagers is based on a comparison of a roll results with the respective preset wager outcome criteria for determining whether the wager is won or lost, or perhaps pushed (that is, neither won nor lost), or something else, such as carried over so that the outcome is determined according to a subsequent roll result in the same series.

A first initial wager can be received having a first preset wager outcome criteria of the first initial wager being won when the dice roll result is seven, being lost when the dice roll result is two or twelve and being a push if the dice roll result is any other numbers (that is, 3, 4, 5, 6, 8, 10 or 11). In some embodiments, when the dice roll result is seven, the payout is greater than even money, such as six to five, whereas in other embodiments the payout is even money on seven. In all other instances, that is, the roll results of three through six or eight through eleven, the first initial wager is determined as being won responsive to a dice roll result of the same number occurring again before a dice roll result of seven occurs, and lost responsive to a dice roll result of seven occurring prior to a dice roll result of the same number occurring. In the exemplary embodiment discussed below, the first initial wager is referred to as the "Bullseye" wager. In some embodiments, the Bullseye wager pays even money with 3 and 11 paying double if the Bullseye is rolled before a seven.

A second initial wager can be received having a second preset wager outcome criteria of the second initial wager being lost when the dice roll result is two or seven and being a push if the dice roll result is any other numbers (that is, 3, 4, 5, 6, 8, 9, 10 or 11). A dice roll result of twelve may tie or lose, depending on the embodiment. In all other instances, that is, roll results of three through six or eight through eleven, the second initial wager is determined as being won responsive to a dice roll result of seven occurring before the dice roll result of the same number occurring again. In the exemplary embodiment discussed below, the first initial wager is referred to as the "Bandit" wager.

A fourth wager can also be received initially pre-roll or post-roll. The fourth wager has a fourth preset wager outcome criteria of the fourth wager being won if the dice roll result achieves a certain condition, such as doubles in which each die has the same number. In the exemplary embodiment discussed below, there are various examples of the fourth wager, such as the "Doubles" wager.

A fifth initial wager can also be received initially pre-roll. The fifth initial wager has a fifth preset wager outcome criteria of the fifth wager being won if the number of dice rolls reach at least a preset number before a certain number, such as a seven, is received by a dice roll result. An example of the fifth initial wager is the "Bonanza" wager discussed herein below. Other wagers are discussed below in reference to the exemplary embodiment.

As shown by step 104, gaming implements, such as a set of dice, which may be rolled freely on a gaming table or tossed in a dice tumbler, are used to generate a random numerical result of between two and twelve, or alternatively, an electromechanical dice rolling device, or an electronic or virtual dice simulation, which may be in communication with a random number generator, is used to generate a random numerical result of between two and twelve.

In step 106, wagers are resolved, if possible, based on a comparison of the dice roll result received in step 104 with the applicable preset wager outcome criteria for the particular wager.

As shown by step 108, the dice roll result is compared with the series ending event criteria to determine if the series ending event has occurred. If the series ending event has occurred then in step 110 of this exemplary embodiment, any wagers not resolved in step 106 are forfeit and collected to be made ready for a new series starting with a pre-initial roll wager. If the series ending event has not occurred then the game continues so that additional post-initial roll wagers are received in step 112 and additional dice roll results are generated in step 104.

Figure 2A:
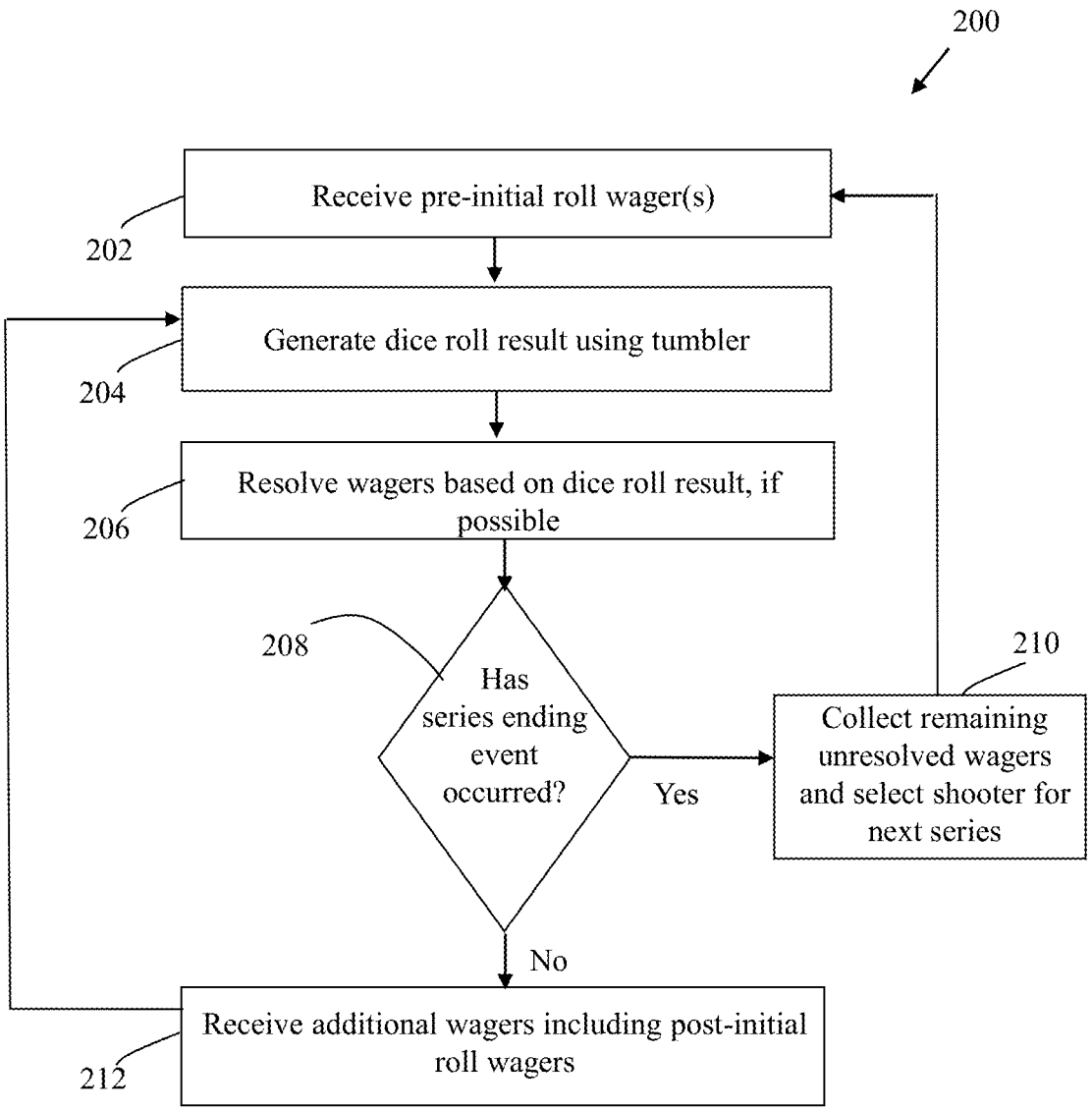
FIG. 2A is a process flow chart depicting another exemplary method for conducting a wagering game configured and constructed according to some embodiments of the invention.
Figure 2B:
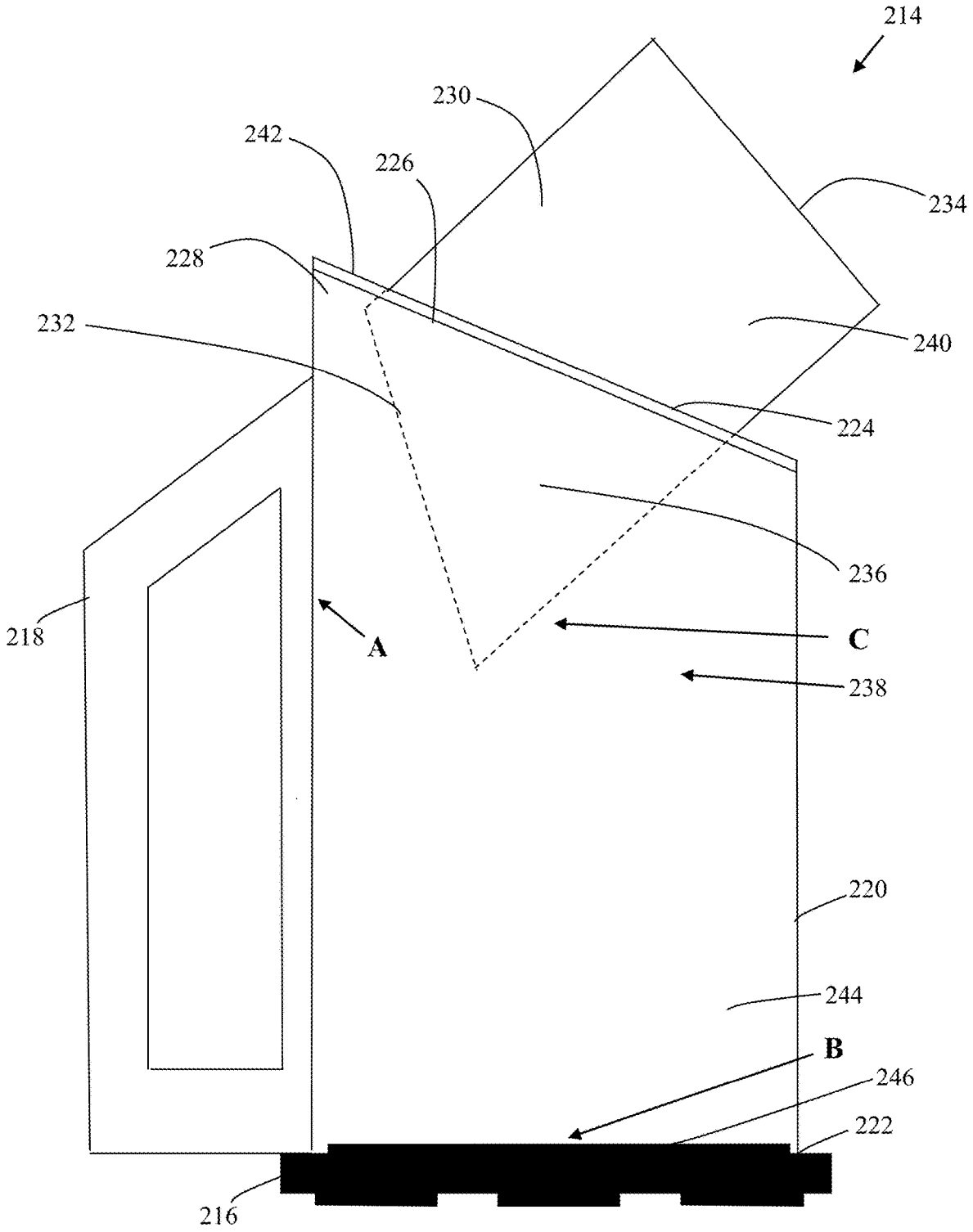
FIG. 2B is a depiction of a dice tumbler constructed in accordance with some embodiments of the invention and which may be used in the implementation of methods of the invention.

An exemplary embodiment referred by the reference numeral 200 is illustrated in FIG. 2A, in which dice are shot by a person, such as a dealer, into or using a dice tumbler containing the dice to generate random dice roll results. The tumbler may be constructed of a transparent plastic material. An exemplary dice tumbler is shown in FIG. 2B and discussed hereinbelow.

Figure 3A:
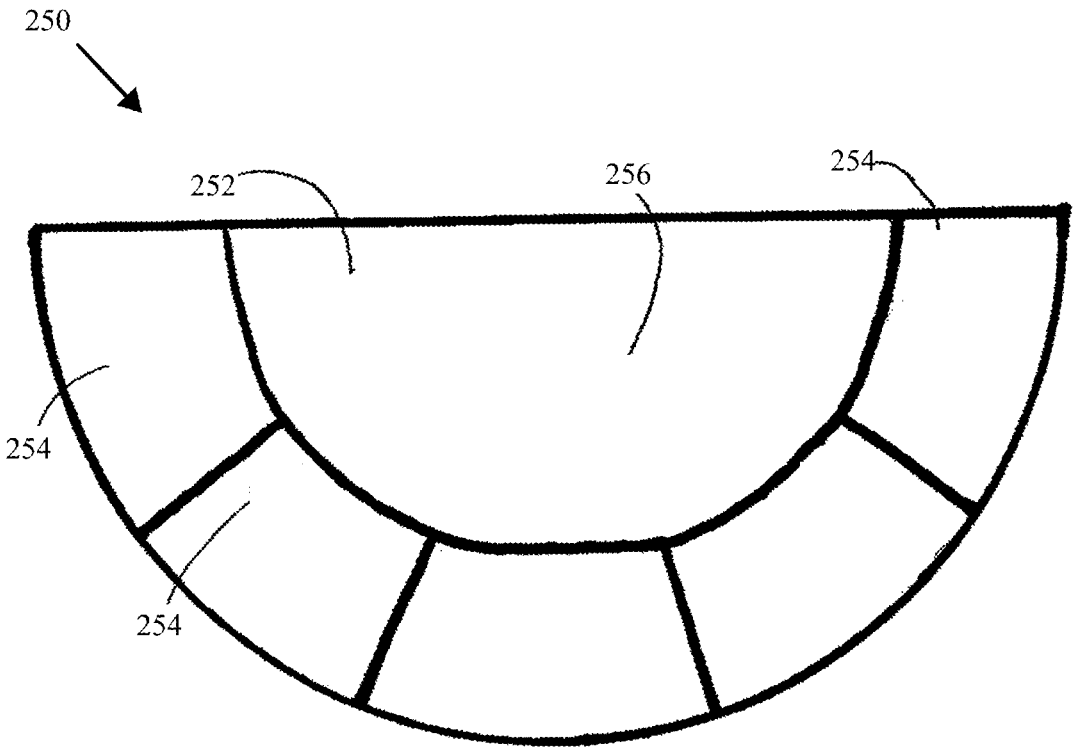
FIG. 3A is diagrams of a playing surface for implementation of a method of providing a wagering game, according to an embodiment of this disclosure.

In step 202, various pre-initial roll wagers may be received, such as by positioning physical wagering implements, such as gaming chips, in designated areas on a playing surface such as playing surface 250 shown in FIG. 3A. In step 204, the initial or come out roll dice roll results are generated and certain wagers received in step 202 may be resolved. In step 212, the post-initial roll wagers are received.

The wagers which may be received in this embodiment include the following wagers referred to by the various names below for non-limiting, illustrative purposes.

A "Bonanza" wager is a pre-initial roll wager which results in a payout responsive to satisfactorily achieving at least a preset number of dice roll results in the ensuing series after the initial roll result, or "First Shot", prior to the occurrence of a dice roll result of seven, also known as a seven-out.

An exemplary, non-limiting paytable for the Bonanza wager is shown below. The paytable lists possible outcomes with their associated awards based on a multiple of the unit wagered.

TABLE 1

| Bonanza Wager | |
|---|---|
| Dice Roll Results before Seven-out | Payout |
| 1-9 | 0 |
| 10-19 | PUSH |
| 20-29 | 5 for 1 |
| 30-39 | 15 for 1 |
| 40-49 | 40 for 1 |
| 50-59 | 50 for 1 |
| 60-69 | 250 for 1 |
| 70-79 | 500 for 1 |
| 80-89 | 1000 for 1 |
| 90-99 | 2500 for 1 |
| 100+ | 20,000 to 1 |

The "Bullseye" wager is a pre-initial roll wager which pays six to five responsive to an initial dice roll result of seven and ties on all other outcomes except for losing on two and twelve. For all other outcomes other than an initial roll of two, seven or twelve, the Bullseye wager wins even money if the same number as the initial roll is rolled again (that is, "hitting the bullseye" so to speak). The Bullseye wager thereafter loses responsive to a seven-out. Another wager, referred to as the "Shooting Star" wager, may be offered which pays on a player hitting multiple Bullseyes (that is, winning the Bullseye wager) before a seven out.

The "Bandit" wager is a pre-initial roll wager which loses responsive to dice roll results of either seven, twelve or two, and ties on all others, winning responsive to a seven out thereafter. In other words, the Bandit wager is a wager that the shooter will not hit the Bullseye (that is, win the Bullseye wager).

While the "Hit Bet" wagers or "Hit Bets" are post-initial roll wagers, and thus may be received in step 212, which lose on two, seven and twelve. "Hit" bet wagers stay active and pay every time a winning event occurs. In this embodiment, winning Hit wagers include winning combinations of three and six, four and five, eight and eleven, and nine and ten, respectively, all of which lose on a dice roll result of two, seven or twelve. The Hit wagers pay even money on dice roll results of five, six, eight and nine. The Hit wagers pay six to five on dice roll results of three, four, ten and eleven. In some embodiments, the "Hit" bet payoffs may be increased, such as in high limit games.

An "Odd Hits" wager may be placed which is determined by a single roll, wherein dice roll results of three, five, nine or eleven. Three and eleven pay even money. Five and nine pay double, all other numbers lose. An "Even Hits" wager may be placed which is determined by a single roll, wherein dice roll results of four, six, eight or ten, these numbers pay even money, all other numbers lose.

The "Lo Hits" wager wins on dice roll results of three, four, five or six, with four paying double, and two and twelve push, while this wager loses on any other dice roll result. The "Hi Hits" wager wins on dice roll results of eight, nine, ten or eleven, with ten paying double, and two and twelve push, while this wager loses on any other dice roll result. In some embodiment's, the "Lo" and "Hi" bet payoffs may be increased, such as in high limit games. A "Medley" wager may be placed which is determined by a single roll, wherein dice roll results of either six or eight wins and pay double, two and twelve push, while the wager loses on any other dice roll result.

While the Hit bets are post-initial roll wagers, players may place a wager which increases payouts but is effective, that is, wins or loses, on the following dice roll result only and is not a multi-roll wager.

A bet referred to as the "Hit Hop Edge" wager is a one roll bet that may be placed on the total dice results of any single Hit number in the dice roll outcome, such as four, for example. In other words, wagers may be received on roll results of 3, 4, 5, 6, 8, 9, 10 or 11 in any way, that is, any combination of specific die results. This bet loses if any number rolls other than the Hit number wagered on, except that Hit Hop wagers tie on two and twelve, thus providing another chance for the player to win. Payouts may be fixed according to the table below:

| Roll Result | Payout for winning Hit Hop Edge bet |
|---|---|
| 2 | Tie |
| 3 | 14 to 1 |
| 4 | 9 to 1 |
| 5 | 6.5 to 1 |
| 6 | 5 to 1 |
| 8 | 5 to 1 |
| 9 | 6.5 to 1 |
| 10 | 9 to 1 |
| 11 | 14 to 1 |
| 12 | Tie |

Wagers may also be received and determined on the specific die rolls in a dice result combination. While a "Bullseye Hop" wager may be placed as a bet on the established Bullseye.

The "Doubles" wager pays an odds payout, such as five to one, when the dice roll results are a specific double selected by placing a wager on a designated area of the playing surface and stay active, that is continue to pay upon satisfaction of the winning criteria, and lose only responsive to dice roll results of any seven.

The "Horns" wager pays an odds payout on dice roll results of two and twelve, and three and eleven.

The "No Hi Lo" wager is a lay bet against rolling a two or twelve in which players "lay" or risks three units to win one. A vig may be charged for this wager. This is a multi-roll bet, wherein a seven roll result before a two or twelve roll result wins, whereas a two or twelve roll result before a seven is a loss.

The "Lay the Horns" wager is a lay bet against rolling a two, three, eleven or twelve in which players are paid even money. A vig may be charged for this wager. This is a multi-roll bet, wherein a seven roll result before a two, three, eleven or twelve roll result wins, whereas a two, three, eleven or twelve roll result before a seven is a loss.

Other wagers may be included as well and received in either step 202 or 212, such as the "Get Lucky" wager which wins based on consecutive Hi or Lo Hits; the "Hit Maker" wager pays on the number of Hits in a series, before any two, seven or twelve occurs as the dice roll results; the "Shooting Star" wager pays based on the number of points won in a series, that is, dice roll results of numbers three, four, five, six, eight, nine, ten and eleven twice in one series.

After dice roll results are generated in step 204 and wagers resolved in step 206, the dice roll result is compared with the series ending event criteria in step 208 to determine if the series ending event has occurred, which in this embodiment may be a dice roll result of two.

In some embodiments, the Target roll in the come out roll sets the Bullseye and therefore in this embodiment, the Target roll cannot be two, seven or twelve, because these numbers cannot establish the "target" or be the Bullseye. Thus, the Target roll continues until it qualifies, that is, until a Bullseye number is rolled.

If the series ending event has occurred then in step 210 of this exemplary embodiment, any wagers not resolved in step 206 are forfeit and a new player seated at the playing surface is selected as the "shooter" for the next series. If the series ending event has not occurred then the game continues so that additional post-initial roll wagers are received in step 212 and additional dice roll results are generated in step 204, which count as post-initial roll wagers.

In an exemplary embodiment, a game of the invention is played at a gaming table offering the following non-limiting Odd Hits and Even Hits wagers as shown in the tables below:

Wager 1 (One Roll Wager)
Name: Odd Hits
Numbers: 3-5-9-11
No Ties
Payouts: 3, 11 pay even money; 5, 9 pay 2 to 1
Alternative Payouts: 3, 5, 9 and 11 pay 9 to 5
Wager 2 (One Roll Wager)
Name: Even Hits
Numbers: 4-6-8-10
No Ties
Payouts: 4, 6, 8, 10 pays even money
Alternative Payouts: 4 and 10 pay 6 to 5

In some embodiments, the following Lo Hits, Medley and Hi Hits wagers are available at anytime:

Wager 1 (One Roll Wager)
Name: Lo Hits
Numbers: 3, 4, 5, 6
4 pays 2 to 1 and/or 5 pays 2 to 1
2 and 12 ties
Wager 2 (One Roll Wager)
Name: Medley
Numbers: 6 and 8

Figure 2C:
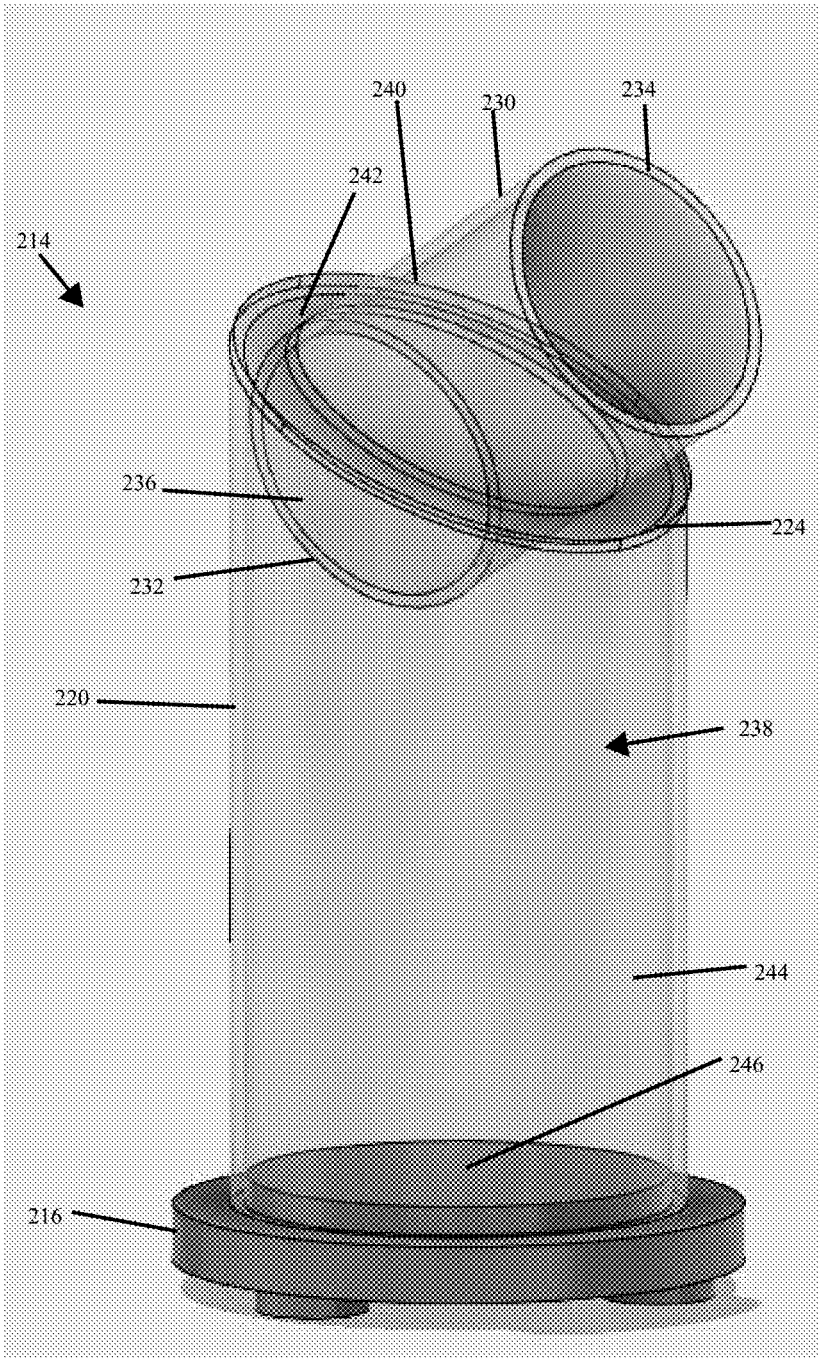
FIG. 2C is a depiction of the dice tumbler shown in FIG. 2B, with the handle removed for ease of illustration.

6, 8 pays 2 to 1 (either one wins) or 6, 8 pay 11 to 5
2 and 12 ties
Wager 3 (One Roll Wager)
Name: Hi Hits
Numbers: 8, 9, 10, 11
10 pays 2 to 1 and/or 9 pays 2 to 1
2 and 12 ties FIGS. 2B and 2C illustrates a dice tumbler 214 of the invention which may be used to facilitate implementations of gaming methods as discussed herein. Dice tumbler 214 includes a base 216, handle 218 and generally tubular shaped body 220. Base 216 may be constructed of any plastic or resilient but slightly deformable material, and may be rubberized or rubber coated. Body 220 may be constructed of acrylic or any plastic. In some embodiments, base 216 and/or body 220 may be fully or partially transparent, while in others base 216 may be opaque. Body 220 is connected with base 216 at a first end 222. Body 220 includes an opening 224 defined by a rim 226 at second end 228. Opening 224 and rim 226 are not perpendicular with respect to the axial length of body 220, but rather create an angular profile.

A tubular member 230 with opposing first and second open ends 232 and 234 is mounted in opening 224 at a transverse angle with respect to the plane defined by rim 226 such that a first portion 236 of tubular member 230 extends through opening 224 and into tubular volume 238 defined by body 220, and a second portion 240 of tubular member 230 protrudes from opening 224.

The diameter of tubular member 230 is less than the diameter of opening 224 and body 220. Thus, rim 226 includes lip 242 extending radially inward to cover the portion of opening 224 between the outside diameter of body 220 and the outside diameter of tubular member 230. Lip 242 contacts the outer surface of tubular member 230 and in this embodiment, secures tubular member 230 in place as shown.

In some embodiments, rim 226 and/or one or more edges of tubular member 230 are polished and rounded. Tubular member 230 may be constructed of acrylic or any plastic.

In operation, dice are tossed into tumbler 214 through second open end 234 of tubular member 230. Dice pass through tubular member 230 and into body 220 of tumbler 214 through first open end 232 and ricochet through volume 238 onto inner surfaces of wall 244 of body 220 until coming to a rest on inner base surface 246 of base 216. Using handle 218 to facilitate removal of base 216 from body 220, the dice are shown as the dice roll result. Dice are then taken from the base and base 216 is reattached with body 220 and made accessible for the next toss of dice into tumbler 214. Body 220 can be non-permanently and removably connected with base 216 in any manner, such as being rested on base 216, placed within a circular groove defined in base 216, snap fit with base 216 or latched to base 216.

As an illustration, tumbler 214 is not shaken. Rather, dice are pitched into tubular member 230 together simultaneously using a combination of the thumb and a finger. Tumbler 230 operates by force of gravity, plus acceleration and motion as determined by the pitch into the tumbler. In this embodiment there are no fixed angular points directing the dice towards base 216. Three main points of deflection and return include points A, B and C, that is, the inner surface of wall 244 adjacent to the first open end 232 of tubular member 230, the inner surface within tubular volume 238 at surface 246 of base 216 and the outer surface of the first portion 236 of tubular member 230. The particular locations are partially dependent on acceleration and angular velocity of the dice pitched by the shooters hand. The points of impact create a ricochet effect while cylindrical wall 244 minimizes friction, enabling sliding, spinning, twirling and tumbling actions consistently resulting in random dice roll results. Dice come to rest on the surface 246 of base 216 within the tube 220 and are read as the dice roll result. In some embodiments, handle 218 may facilitate disconnecting body 220 from base 216 to enable the dice to be removed and presented to the next shooter for the next roll.

Various platforms are contemplated that are suitable for implementation of embodiments of wagering games according to this disclosure. For example, embodiments of wagering games may be implemented as live table games with an in-person dealer, electronic gaming machines, partially or fully automated table games, and fully automated, network-administered games (e.g., Internet games) that either produce game results utilizing a processor, or produce a live video feed of a dealer administering a game from a remote studio.

As previously noted, any of the present methods and games may be played as a live casino game, as a hybrid casino game (with virtual cards or virtual dice), on a multi-player electronic platform, on a personal computer for practice, on a hand-held game for practice, on a legally-authorized site on the Internet, or on a play-for-fun site on the Internet, or through any other communication network.

For example, in one embodiment, the players may be remotely located from a live dealer, and a live dealer and a game table may be displayed to players on their monitors via a video feed. The players' video feeds may be transmitted to the dealer and may also be shared among the players at the table. In a sample embodiment, a central station may include a plurality of betting-type game devices and an electronic camera for each game device. A plurality of player stations, remotely located with respect to the central station, may each include a monitor, for displaying a selected game device at the central station, and input means, for selecting a game device and for placing a bet by a player at the player's station relating to an action involving an element of chance to occur at the selected game device.

Referring to FIG. 3A, shown is a diagram of a playing surface 250 for implementation of the wagering games within the scope of the present disclosure. The gaming table surface 252 is provided by the administrator and may include multiple player areas 254 (e.g., four to seven player areas 254). While five player positions or areas 254 are shown in this embodiment, this is for illustrative purposes only. The gaming table surface 252 may also include various wager tracking areas for the placement of markers to track wagers such as the Bonanza wager discussed above. A "point establishment" area 256 in which the points, that is, numbers three, four, five, six, eight, nine, ten and eleven, are identified is also included on surface 252.

Figure 3B:
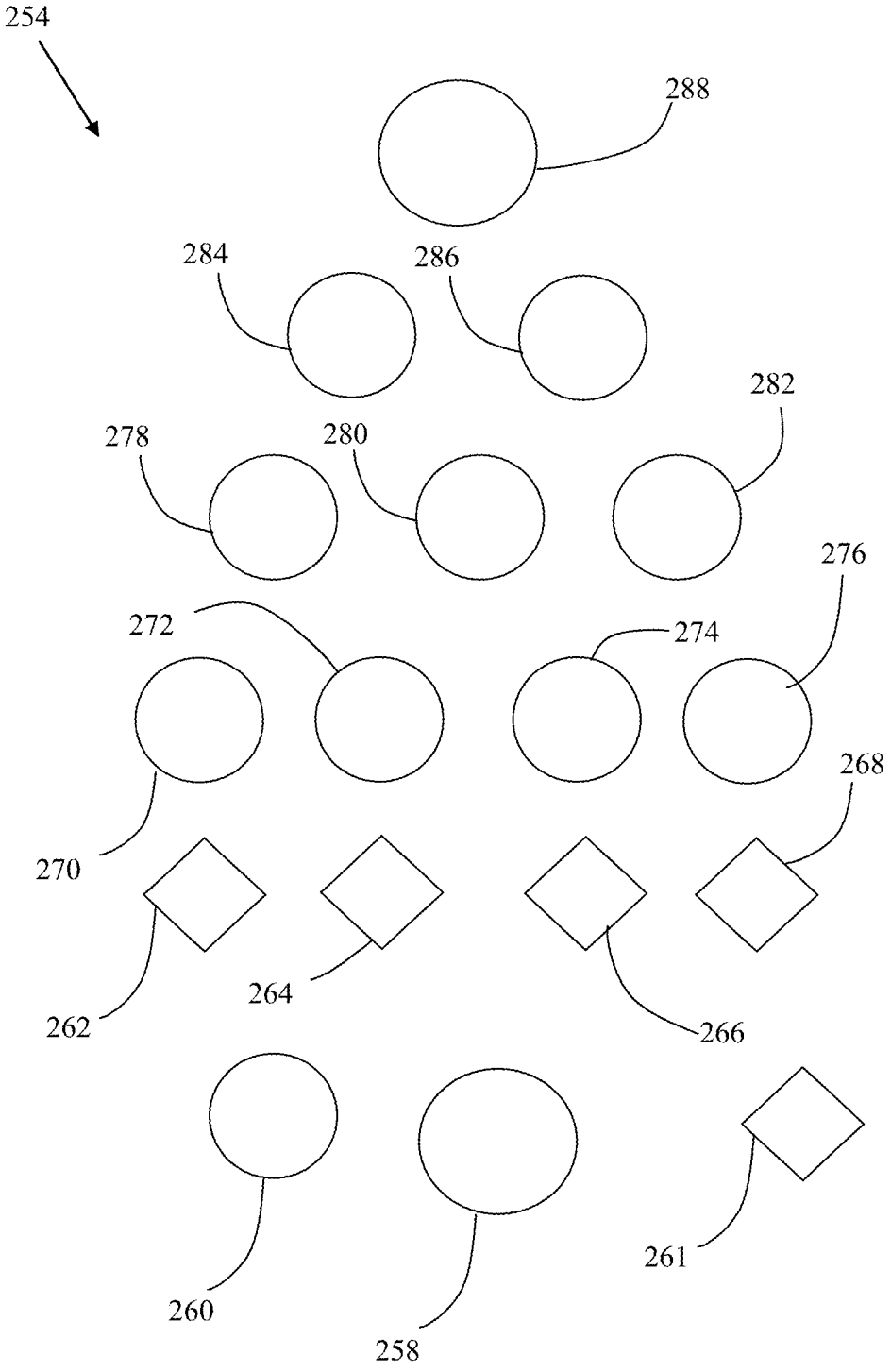
FIG. 3B is diagram of a single playing position on the playing surface shown in FIG. 3A.

As shown in FIG. 3B, each player area 254 includes wager areas for the physical placement of gaming chips, including for example, as described above, Bullseye wager area 258, Bandit wager area 260, Shooting Star wager area 261, Four Doubles wager area 262, Six Doubles wager area 264, Eight Doubles wager area 266, Ten Doubles wager area 268, Four and Five Hit wager area 270, Three and Six Hit wager area 272, Eight and Eleven Hit wager area 274, Nine and Ten Hit wager area 276, Lo Hits wager area 278, Medley wager area 280, Hi Hits wager area 282, Odd Hits wager area 284 Even Hits wager area 286 and Bullseye Hop wager area 288. Wagers that have been lost may be removed by the administrator (e.g., dealer). Gaming table surface 252 may also display paytables and other game information.

Figure 4:
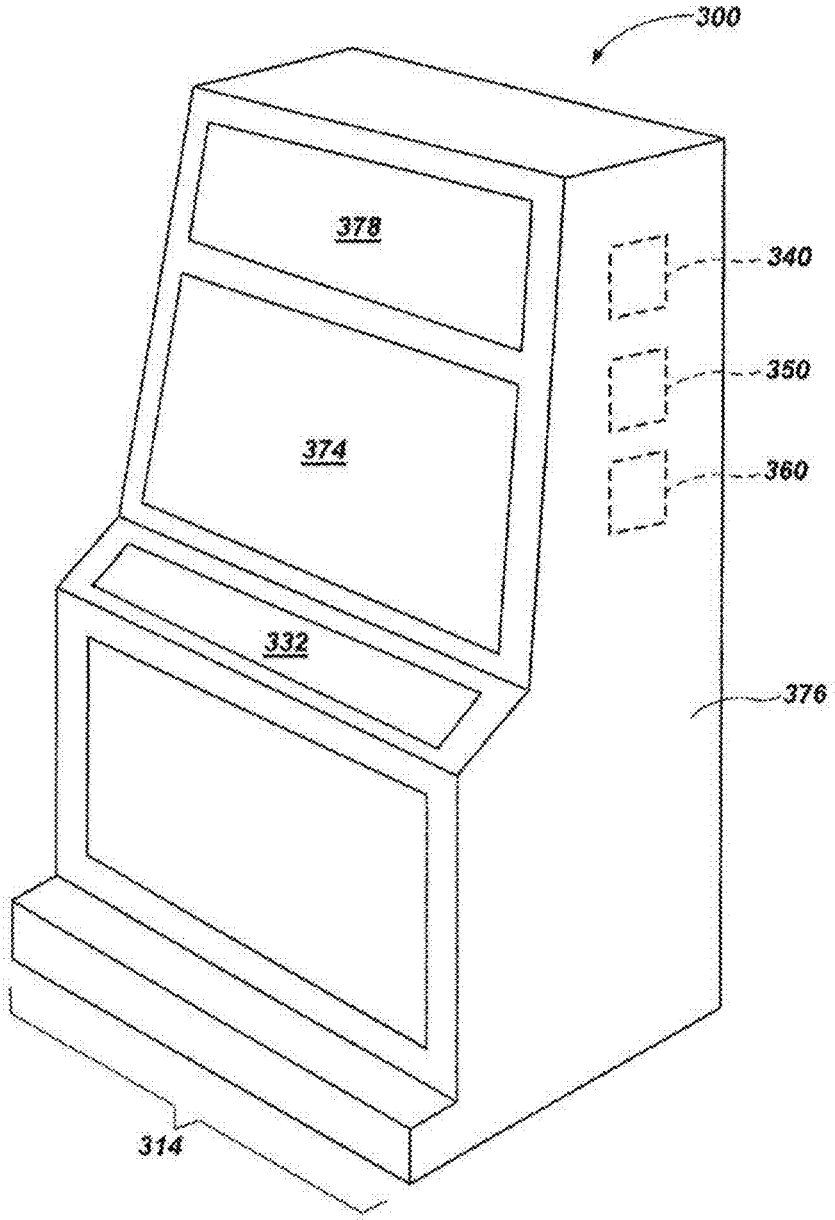
FIG. 4 is a perspective view of an individual electronic gaming device configured for implementation of embodiments of wagering games in accordance with this disclosure.

FIG. 4 is a perspective view of an individual electronic gaming device 300 (e.g., an electronic gaming machine (EGM)) configured for implementing wagering games according to this disclosure. The individual electronic gaming device 300 may include an individual player position 314 including a player input area 332 configured to enable a player to interact with the individual electronic gaming device 300 through various input devices (e.g., buttons, levers, touchscreens). The individual electronic gaming device 300 may include a gaming screen 374 configured to display indicia for interacting with the individual electronic gaming device 300, such as through processing one or more programs stored in memory 340 to implement the rules of game play at the individual electronic gaming device 300. Accordingly, game play may be accommodated without involving physical dice, chips or other wagering elements, and live personnel. The action may instead be simulated by a control processor 350 operably coupled to the memory 340 and interacting with and controlling the individual electronic gaming device 300.

Although the individual electronic gaming device 300 displayed in FIG. 4 has an outline of a traditional gaming cabinet, the individual electronic gaming device 300 may be implemented in other ways, such as, for example, client software downloaded to a portable device, such as a smart phone, tablet, or laptop computer. The individual electronic gaming device 300 may also be a non-portable personal computer (e.g., a desktop or all-in-one computer) or other computing device. In some embodiments, client software is not downloaded but is native to the device or is otherwise delivered with the device when distributed.

A communication device 360 may be included and operably coupled to the processor 350 such that information related to operation of the individual electronic gaming device 300, information related to the game play, or combinations thereof may be communicated between the individual electronic gaming device 300 and other devices such as a server through a suitable communication medium, such, as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners to communicate rules of game play and the like, such as along a top portion 378 of the cabinet 376 of the individual electronic gaming device 300. The individual electronic gaming device 300 may further include additional decorative lights (not shown), and speakers (not shown) for transmitting and optionally receiving sounds during game play.

Some embodiments may be implemented at locations including a plurality of player stations. Such player stations may include an electronic display screen for display of game information (e.g., dice, wagers, and game instructions) and for accepting wagers and facilitating credit balance adjustments. Such player stations may, optionally, be integrated in a table format, may be distributed throughout a casino or other gaming site, or may include both grouped and distributed player stations.

Figure 5:
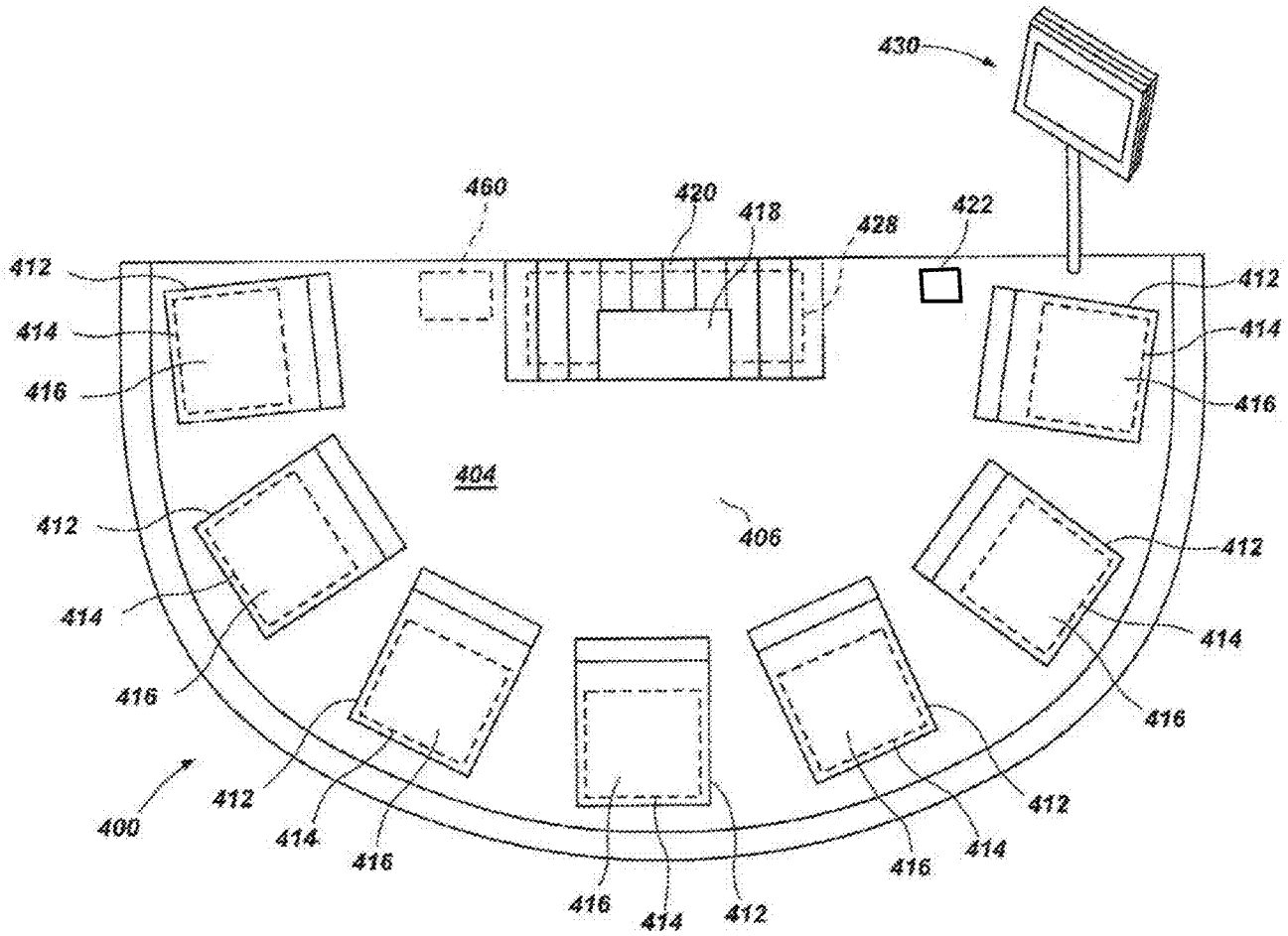
FIG. 5 is a top view of a table configured for implementation of embodiments of wagering games in accordance with this disclosure.

FIG. 5 is a top view of a suitable table 400 configured for implementing wagering games according to this disclosure. The table 400 may include a playing surface 404. The table 400 may include player stations 412. Each player station 412 may include a player interface 416, which may be used for displaying game information (e.g., game instructions, input options, wager information, game outcomes, etc., and accepting player elections). The player interface 416 may be a display screen in the form of a touch screen, which may be at least substantially flush with the playing surface 404 in some embodiments. Each player interface 416 may be operated by its own local game processor 414 (shown in dashed lines), although, in some embodiments, a central game processor 428 (shown in dashed lines) may be employed and may communicate directly with player interfaces 416. In some embodiments, a combination of individual local game processors 414 and the central game processor 428 may be employed.

A communication device 460 may be included and may be operably coupled to one or more of the local game processors 414, the central game processor 428, or combinations thereof, such that information related to operation of the table 400, information related to the game play, or combinations thereof may be communicated between the table 400 and other devices through a suitable communication medium, such as, for example, wired networks, Wi-Fi networks, and cellular communication networks.

Table 400 may further include additional features, such as a dealer chip tray 420, which may be used by the dealer to cash players in and out of the wagering game, whereas wagers and balance adjustments during game play may be performed using, for example, virtual chips (e.g., images or text representing wagers). For embodiments using physical dice, the table 400 may further include a tumbler or may include an automated electromechanical dice roller or bouncing device 422 for automatically rolling and reading the dice roll results and displaying them on a display, such as display 430 described further below. A designated area 406 for the point numbers three, four, five six, eight, nine, ten and eleven may include lights under the table surface which illuminate based on the dice roll results determined by device 422. Players may use the individual player interfaces 416 to initiate a dice roll and the shooter may alternate between interfaces 416 after a series ending event. For embodiments using virtual dice, the virtual dice may be displayed at the individual player interfaces 416.

Table 400 may further include a dealer interface 418, which, like the player interfaces 416, may include touch screen controls for receiving dealer inputs and for assisting the dealer in administering the wagering game. The table 400 further includes upright display 430 configured to display images that depict game information, which may include pay tables, dice roll results, wager outcomes, historical win/loss information by player, and a wide variety of other information considered useful to the players.

Although an embodiment is described showing individual discrete player stations, in some embodiments, the entire playing surface 404 may be an electronic display, that may appear as gaming surface 250, and which is logically partitioned to permit game play from a plurality of players for receiving inputs from, and displaying game information to, the players, the dealer, or both.

Figure 6:
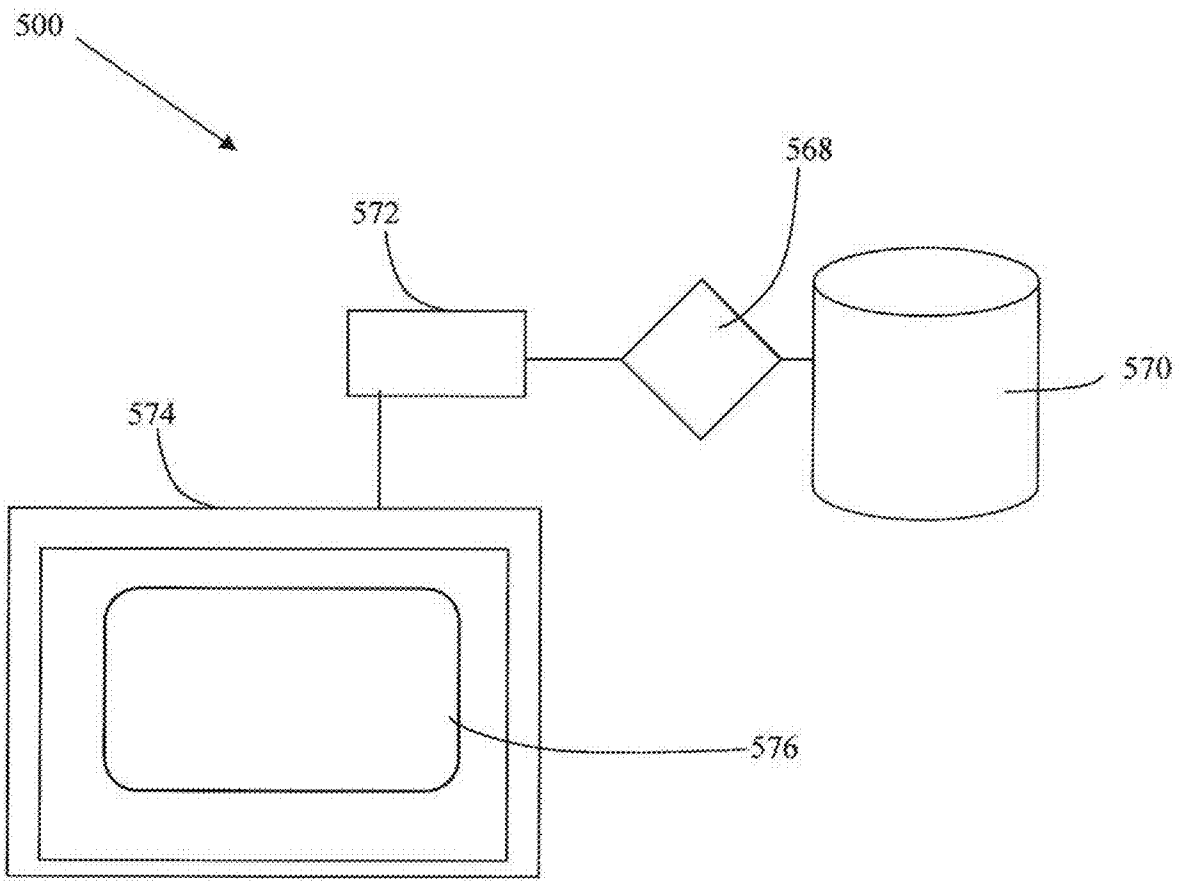
FIG. 6 is a schematic diagram depicting the components of an exemplary system configured and constructed according to some embodiments of the invention.

FIG. 6 illustrates a diagram of an exemplary system 500, which may be a portable device, constructed in accordance with some embodiments of the invention. System 500 includes processing device 568 in communication with a database or memory device 570, communication or data input/output device 572 and a display device 574. In some embodiments, display device 574 is a touch-enabled device and includes a data input device component. Memory device 570 may include data relating to the underlying game and embodiments of the invention as described herein, such as the wager outcome criteria. A player interface 576 can be presented on display device 574. Player interface 576 may be a virtual representation of a game table layout such as surface 250 and/or one or more player positions 252 for facilitating the transmittal and receipt of wagers in accordance with any of the embodiments herein, such as methods 100 or 200. Game outcomes are displayed and wagers are tracked using display device 574 and processing device 568 compares the dice roll results with the relevant wager outcome criteria, and determines an outcome and payout to be displayed on display device 574 accordingly.

Figure 7:
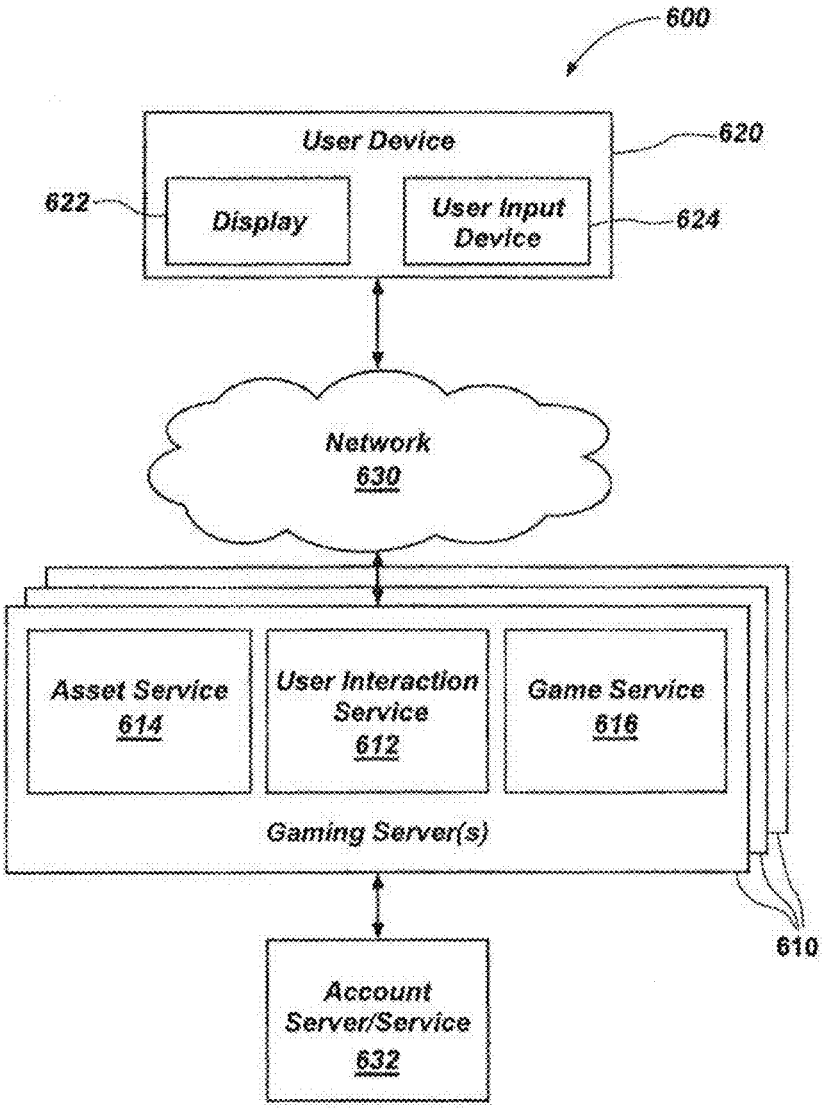
FIG. 7 is a schematic block diagram of a gaming system for implementing embodiments of waging games in accordance with this disclosure.

In some embodiments, wagering games in accordance with this disclosure may be administered using a gaming system employing a client-server architecture (e.g., over the Internet, a local area network, etc.). FIG. 7 is a schematic block diagram of an exemplary gaming system 600 for implementing wagering games so that end users may remotely access games as described herein, among others.

The wagering games supported by the gaming system 600 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This feature may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 600 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 600 may include a gaming platform to establish a portal for an end user to access a wagering game hosted by one or more gaming servers 610 over a network 630. In embodiments, games are accessed through a user interaction service 612. The gaming system 600 enables players to interact with a user device 620 through a user input device 624 and a display 622 and to communicate with one or more gaming servers 610 using a network 630 (e.g., the Internet). Typically the user device is remote from the gaming server 610 and the network is the word-wide web (i.e., internet).

In some embodiments, the gaming servers 610 may be configured as a single server to administer wagering games in combination with the user device 620. In other embodiments, the gaming servers 610 may be configured as separate servers for performing separate, dedicated functions associated with administering wagering games. Accordingly, the following description also discusses "services" with the understanding that the various services may be performed by different servers or combinations of servers in different embodiments. As shown in FIG. 7, the gaming servers 610 may include a user interaction service 612, a game service 616, and an asset service 614. In some embodiments, one or more of the gaming servers 610 may communicate with an account server 632 performing an account service 632. As explained more fully below, for some wagering type games, the account service 632 may be separate and operated by a different entity than the gaming servers 610; however, in some embodiments the account service 632 may also be operated one or more of the gaming servers 610.

The user device 620 may communicate with the user interaction service 612 through the network 630. The user interaction service 612 may communicate with the game service 616 and provide game information to the user device 620. In some embodiments, the game service 616 may also include a game engine. The game engine may comprise game rules. In some embodiments, a single user device 620 communicates with a game provided by the game service 616, while other embodiments may include a plurality of user devices 620 configured to communicate and provide end users with access to the same game provided by the game service 616. In addition, a plurality of end users may be permitted to access a single user interaction service 612, or a plurality of user interaction services 612, to access the game service 616. The user interaction service 612 may enable a user to create and access a user account and interact with game service 616. The user interaction service 612 may enable users to initiate new games, join existing games, and interface with games being played by the user.

The user interaction service 612 may also provide a client for execution on the user device 620 for accessing the gaming servers 610. The client provided by the gaming servers 610 for execution on the user device 620 may be any of a variety of implementations depending on the user device 620 and method of communication with the gaming servers 610. In one embodiment, the user device 620 may connect to the gaming servers 610 using a web browser, and the client may execute within a browser window or frame of the web browser. In another embodiment, the client may be a stand-alone executable on the user device 620.

For example, the client may comprise a relatively small amount of script, also referred to as a "script driver," including scripting language that controls an interface of the client. The script driver may include simple function calls requesting information from the gaming servers 610. In other words, the script driver stored in the client may merely include calls to functions that are externally defined by, and executed by, the gaming servers 610. As a result, the client may be characterized as a "thin client." The client may simply send requests to the gaming servers 610 rather than performing logic itself. The client may receive player inputs, and the player inputs may be passed to the gaming servers 610 for processing and executing the wagering game. In some embodiments, this may involve providing specific graphical display information for the display 622 as well as game outcomes.

As another example, the client may comprise an executable file rather than a script. The client may do more local processing than does a script driver, such as calculating where to show what game symbols upon receiving a game outcome from the game service 616 through user interaction service 612. In some embodiments, portions of an asset service 614 may be loaded onto the client and may be used by the client in processing and updating graphical displays. Some form of data protection, such as end-to-end encryption, may be used when data is transported over the network 630. The network 630 may be any network, such as, for example, the Internet or a local area network.

The gaming servers 610 may include an asset service 614, which may host various media assets (e.g., text, audio, video, and image files) to send to the user device 620 for presenting the various wagering games to the end user. In other words, the assets presented to the end user may be stored separately from the user device 620. For example, the user device 620 requests the assets appropriate for the game played by the user; as another example, especially relating to thin clients, just those assets that are needed for a particular display event will be sent by the gaming servers 610, including as few as one asset. The user device 620 may call a function defined at the user interaction service 612 or asset service 614, which may determine which assets are to be delivered to the user device 620 as well as how the assets are to be presented by the user device 620 to the end user. Different assets may correspond to the various user devices 620 and their clients that may have access to the game service 616 and to different variations of wagering games.

The gaming servers 610 may include the game service 616, which may be programmed to administer wagering games and determine game play outcomes to provide to the user interaction service 612 for transmission to the user device 620. For example, the game service 616 may include game rules for one or more wagering games, such that the game service 616 controls some or all of the game flow for a selected wagering game as well as the determined game outcomes. The game service 616 may include pay tables and other game logic. The game service 616 may perform random number generation for determining random dice roll results for the wagering game. In one embodiment, the game service 616 may be separated from the user interaction service 612 by a firewall or other method of preventing unauthorized access to the game service 612 by the general members of the network 630.

The user device 620 may present a gaming interface to the player and communicate the user interaction from the user input device 624 to the gaming servers 610. The user device 620 may be any electronic system capable of displaying gaming information, receiving user input, and communicating the user input to the gaming servers 610. For example, the user device 620 may be a desktop computer, a laptop, a tablet computer, a set-top box, a mobile device (e.g., a smartphone), a kiosk, a terminal, or another computing device. As a specific, non-limiting example, the user device 620 operating the client may be an interactive electronic gaming system 300 (see FIG. 4) or portable system 500 (see FIG. 6), as described above. The client may be a specialized application or may be executed within a generalized application capable of interpreting instructions from an interactive gaming system, such as a web browser.

The client may interface with an end user through a web page or an application that runs on a device including, but not limited to, a smartphone, a tablet, or a general computer, or the client may be any other computer program configurable to access the gaming servers 610. The client may be illustrated within a casino webpage (or other interface) indicating that the client is embedded into a webpage, which is supported by a web browser executing on the user device 620.

In some embodiments, components of the gaming system 600 may be operated by different entities. For example, the user device 620 may be operated by a third party, such as a casino or an individual, that links to the gaming servers 610, which may be operated, for example, by a wagering game service provider. Therefore, in some embodiments, the user device 620 and client may be operated by a different administrator than the operator of the game service 616. In other words, the user device 620 may be part of a third-party system that does not administer or otherwise control the gaming servers 610 or game service 616. In other embodiments, the user interaction service 612 and asset service 614 may be operated by a third-party system. For example, a gaming entity (e.g., a casino) may operate the user interaction service 612, user device 620, or combination thereof to provide its customers access to game content managed by a different entity that may control the game service 616, amongst other functionality. In still other embodiments, all functions may be operated by the same administrator. For example, a gaming entity may elect to perform each of these functions in-house, such as providing access to the user device 620, delivering the actual game content, and administering the gaming system 600.

The gaming servers 610 may communicate with one or more external account servers 632 (also referred to herein as an account service 632), optionally through another firewall. For example, the gaming servers 610 may not directly accept wagers or issue payouts. That is, the gaming servers 610 may facilitate online casino gaming but may not be part of a self-contained online casino itself. Another entity (e.g., a casino or any account holder or financial system of record) may operate and maintain its external account service 632 to accept bets and make payout distributions. The gaming servers 610 may communicate with the account service 632 to verify the existence of funds for wagering and to instruct the account service 632 to execute debits and credits. As another example, the gaming servers 610 may directly accept bets and make payout distributions, such as in the case where an administrator of the gaming servers 610 operates as a casino.

Additional features may be supported by the gaming servers 610, such as hacking and cheating detection, data storage and archival, metrics generation, messages generation, output formatting for different end user devices, as well as other features and operations.

Figure 8:
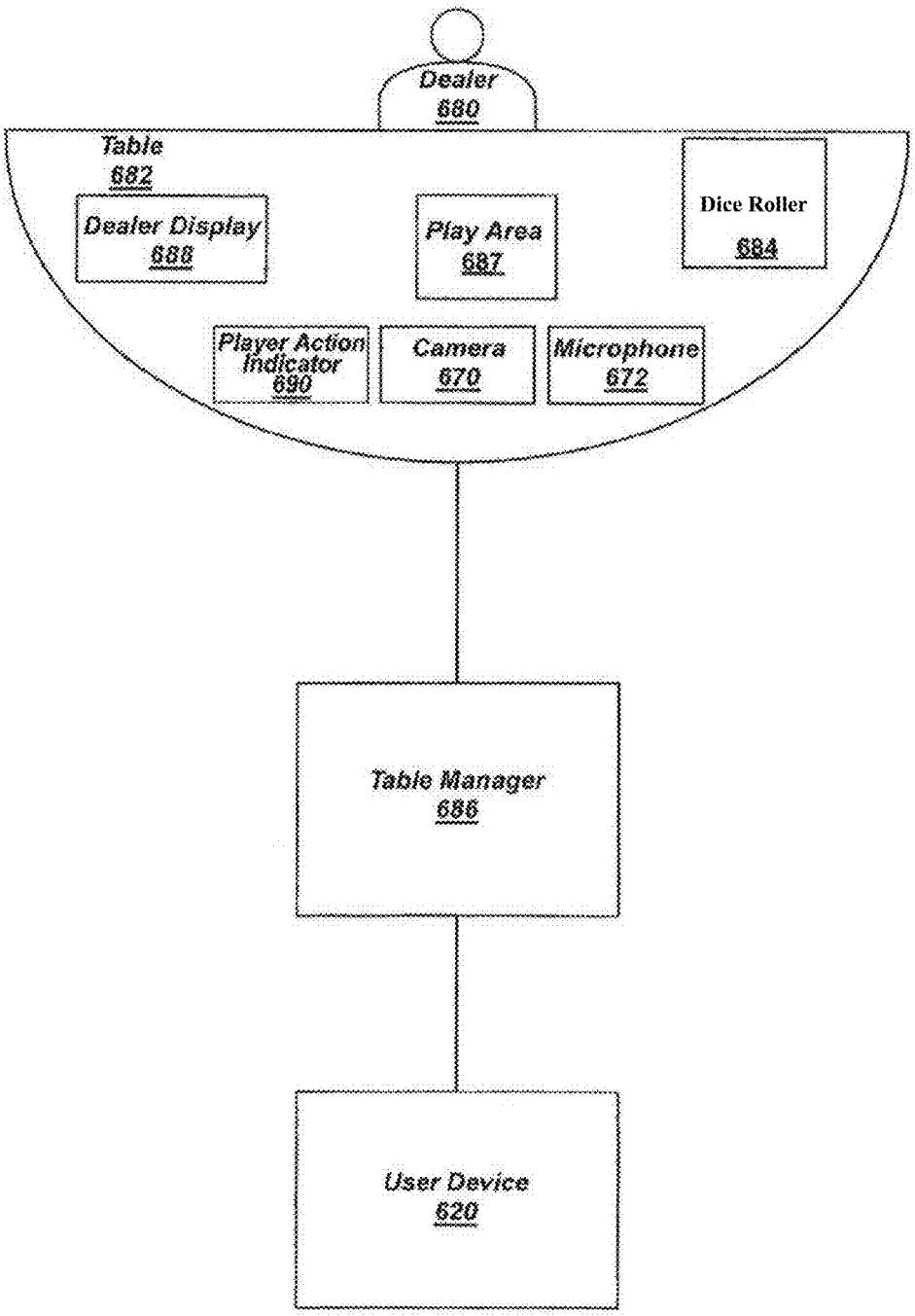
FIG. 8 is a schematic block diagram of a gaming system for implementing embodiments of wagering games including a live dealer feed.

FIG. 8 is a schematic block diagram of a table 682 for implementing wagering games including a live dealer feed. Features of the gaming system 600 described above in connection with FIG. 7 may be utilized in connection with this embodiment, except as further described. Rather than dice being determined by a computerized random processes, physical dice may be rolled by a live dealer 680 at a table 682 using a dice roller 684, such as a tumbler containing dice or a electromechanical stationary dice rolling device. A table manager 686 may assist the dealer 680 in facilitating play of the game by transmitting a video feed of the dealer's actions to the user device 620 and transmitting player elections to the dealer 680. As described above, the table manager 686 may act as or communicate with a gaming system 600 itself or as an intermediate client interposed between and operationally connected to the user device 620 and the gaming system 600 to provide gaming at the table 682 to users of the gaming system 600. Thus, the table manager 686 may communicate with the user device 620 through network 630, and may be a part of a larger online casino, or may be operated as a separate system facilitating game play. In various embodiments, each table 682 may be managed by an individual table manager 686 constituting a gaming device, which may receive and process information relating to that table. For simplicity of description, these functions are described as being performed by the table manager 686, though certain functions may be performed by an intermediary gaming system 600, such as the one shown and described in connection with FIG. 7. In some embodiments, the gaming system 600 may match remotely located players to tables 682 and facilitate transfer of information between user devices 620 and tables 682, such as wagers and wagering amounts, without managing gameplay at individual tables. In other embodiments, functions of the table manager 686 may be incorporated into a gaming system 600.

The table 682 includes a camera 670 and optionally a microphone 672 to capture video and audio feeds relating to the table 682. The camera 670 may be trained on the dealer 680, play area 687, and a dice roller 684. As the game is administered by the dealer 680, the video feed captured by the camera 670 may be shown to the player using the user device 620, and any audio captured by the microphone 672 may be played to the player using the user device 620. In some embodiments, the user device 620 may also include a camera, microphone, or both, which may also capture feeds to be shared with the dealer 680 and other players. In some embodiments, the camera 670 may be trained to capture images of the dice rolling, dice roll results, chips, and chip stacks on the surface of the gaming table and perform dice recognition routines to identify the dice roll results.

Dice roll results and wager data in some embodiments may be used by the table manger 686 to determine wager outcomes. The data extracted from the camera 670 may be used to confirm the dice roll results and for general security monitoring purposes.

The live video feed permits the dealer to show dice roll results and play the game as though the player were at a live casino. In addition, the dealer can prompt a user by announcing outcomes and opportunities to place certain wagers, such as the post-initial roll wagers. In embodiments in which a microphone 672 is included, the dealer 680 can verbally announce actions or outcomes. In some embodiments, the user device 620 also includes a camera or microphone, which also captures feeds to be shared with the dealer 680 and other players.

The play area 687 may depict a player positions for playing the game, such as surface 250 shown in FIG. 3. As determined by the rules of the game, the player at the user device 620 may be presented options for responding to an event in the game using a client as described with reference to FIG. 7.

Player selections may be transmitted to the table manager 686, which may display player elections to the dealer 680 using a dealer display 688 and player action indicator 690 on the table 682. For example, the dealer display 688 may display information regarding who is the next shooter or when to generate a dice roll result.

In some embodiments, the table manager 686 may receive dice results information such as the specific results for each die. The table manager 686 may apply game rules and wager outcome criteria to the information to determine gameplay events, such as the occurrence of a series ending event, and wager results. Alternatively, the wager results may be determined by the dealer 680 and input to the table manager 686, which may be used to confirm automatically determined results by the gaming system.

Figure 9:
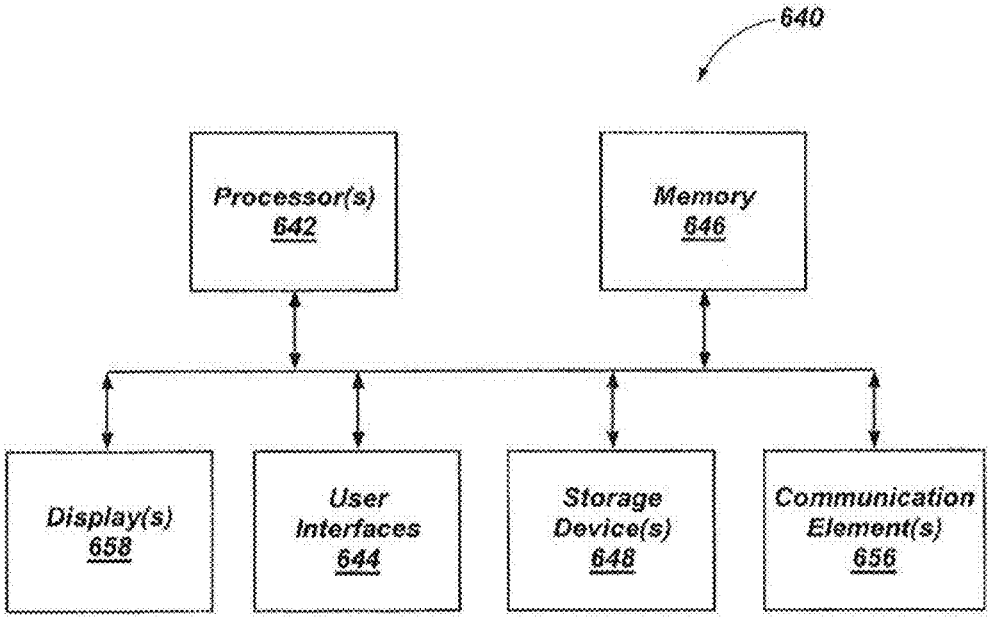
FIG. 9 is a block diagram of a computer for acting as a gaming system for implementing embodiments of wagering games in accordance with this disclosure.

FIG. 9 is a simplified block diagram showing elements of computing devices that may be used in systems and apparatuses of this disclosure. The computing system 640 may be a user-type computer, a file server, a computer server, a notebook computer, a tablet, a handheld device, a mobile device, or other similar computer system for executing software. The computing system 640 may be configured to execute software programs containing computing instructions and may include one or more processors 642, memory 646, one or more displays 658, one or more user interface elements 644, one or more communication elements 656, and one or more storage devices 648 (also referred to herein simply as storage 648).

The processors 642 may be configured to execute a wide variety of operating systems and applications including the computing instructions for administering wagering games of the present disclosure.

The memory 646 may be used to hold computing instructions, data, and other information for performing a wide variety of tasks including administering wagering games of the present disclosure. By way of example, and not limitation, the memory 646 may include Synchronous Random Access Memory (SRAM), Dynamic RAM (DRAM), Read-Only Memory (ROM), Flash memory, and the like.

The display 658 may be a wide variety of displays such as, for example, light emitting diode displays, liquid crystal displays, cathode ray tubes, and the like. In addition, the display 658 may be configured with a touch-screen feature for accepting user input as a user interface element 644.

As non-limiting examples, the user interface elements 644 may include elements such as displays, keyboards, push buttons, mice, joysticks, haptic devices, microphones, speakers, cameras, and touchscreens.

As non-limiting examples, the communication elements 656 may be configured for communicating with other devices or communication networks. As non-limiting examples, the communication elements 656 may include elements for communicating on wired and wireless communication media, such as for example, serial ports, parallel ports, Ethernet connections, universal serial bus (USB) connections, IEEE 1394 ("firewire") connections, Thunderbolt™ connections, Bluetooth® wireless networks, ZigBee wireless networks, 802.11 type wireless networks, cellular telephone/data networks, and other suitable communication interfaces and protocols.

The storage 648 may be used for storing relatively large amounts of nonvolatile information for use in the computing system 640 and may be configured as one or more storage devices. By way of example, and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

A person of ordinary skill in the art will recognize that the computing system 640 may be configured in many different ways with different types of interconnecting buses between the various elements. Moreover, the various elements may be subdivided physically, functionally, or a combination thereof. As one non-limiting example, the memory 646 may be divided into cache memory, graphics memory, and main memory. Each of these memories may communicate directly or indirectly with the one or more processors 642 on separate buses, partially-combined buses, or a common bus.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality. However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," "determining," or the like, refer to the action and processes of a computer system, or similar electronic computing device (such as a specific computing machine), that manipulates and transforms data represented as physical (electronic) quantities within the computer system memories or registers or other such information storage, transmission or display devices.

Certain aspects of the embodiments include process steps and instructions described herein in the form of an algorithm. It should be noted that the process steps and instructions of the embodiments can be embodied in software, firmware, or hardware, and when embodied in software, could be downloaded to reside on and be operated from different platforms used by a variety of operating systems. The embodiments can also be in a computer program product, which can be executed on a computing system.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for the purposes of enablement and best mode.

Those skilled in the art will appreciate that the types of software and hardware used are not vital to the full implementation of the methods of the invention. The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

While exemplary systems and methods, and applications of methods of the invention, have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth in the claims and equivalents thereto.

The invention claimed is:

1. A dice game apparatus comprising:

a) a game table surface having a semicircular peripheral edge about which a plurality of player positions are located, the game table surface having designated thereon a plurality of wagering receiving areas corresponding to each of the player positions in a repetitive pattern along a peripheral portion of the game table surface, the wager receiving areas designating the only place on which the players may place a wager and the wager is received;

b) a set of at least two dice having six faces with numerical representations thereon; and c) a tumbler, comprising:

i) a base, wherein the base defines a planar surface;

ii) an axial tube having a curved wall, a first end and a second end defining an inner volume, the first end of the axial tube being removably connected with the base, the planar surface defining a planar inner surface within the axial tube; and iii) a transverse tube having a curved wall, an open first end and an open second end, the second end of the transverse tube being securely connected to the second end of the axial tube and extending into the inner volume of the axial tube at a transverse angle relative to the axial tube, wherein the second end and a portion of the curved wall of the transverse tube are adjacent to an inner portion of the curved wall of the axial tube, wherein the set of at least two dice inserted into the open first end of the transverse tube pass through the transverse tube and enter the inner volume of the axial tube from the second end of the transverse tube, coming to rest thereafter on the planar inner surface.

* * * * *